United States Patent [19]

Weisgerber

[11] 4,106,646

[45] Aug. 15, 1978

[54] LOAD HANDLING VEHICLE

[75] Inventor: Charles E. Weisgerber, Portland, Oreg.

[73] Assignee: Raygo Wagner, Inc., Portland, Oreg.

[21] Appl. No.: 686,926

[22] Filed: May 17, 1976

[51] Int. Cl.[2] ..... B66F 9/00

[52] U.S. Cl. ..... 214/147 R; 294/88

[58] Field of Search ..... 214/147 R, 147 T, 147 G, 214/147 AS, 650 R, 651, 652, 653, 654, 655, 3; 294/88

[56] References Cited

U.S. PATENT DOCUMENTS

| | | | |
|---|---|---|---|
| 2,776,768 | 1/1957 | Carlson | 214/147 R |
| 2,958,434 | 11/1960 | Wagner | 214/147 R X |
| 3,034,821 | 5/1962 | Hackett et al. | 214/147 G X |
| 3,125,234 | 3/1964 | Gustine | 214/147 G X |
| 3,221,909 | 12/1965 | Magnuson | 214/147 R |
| 3,239,082 | 3/1966 | Herolf | 214/147 X |
| 3,281,119 | 10/1966 | Westfall | 214/147 R X |
| 3,669,293 | 6/1972 | Bryan et al. | 214/147 X |

*Primary Examiner*—Frank E. Werner
*Attorney, Agent, or Firm*—Klarquist, Sparkman, Campbell, Leigh, Hall and Whinston

[57] ABSTRACT

A lift truck has a log handling carriage head carried by a vertically movable boom. The boom is pivoted to the truck frame below the operator's cab to provide a clear line of sight from the cab along the top of the boom to the carriage head in any position of the boom. The carriage head comprises a pair of independently operable, vertically disposed, transversely separated, articulated claws. The claws are pivoted to opposite side extensions of the outer end of the boom for improved visibility to the load. Each claw includes a generally upstanding main carriage member, a fork extending forwardly from a lower end of such member, and a tusk curving forwardly and downwardly from the upper end of such member. The fork and main carriage member of each claw pivot about a common transverse axis, and the vertical angle of each fork is adjustable independently of the other by pivoting its associated main carriage member independently of the other such member. Each fork is free floating within limits relative to its main carriage member so that when the fork contacts the ground, its main carriage member may be pivoted without moving the fork. A tandem hydraulic cylinder and crank mechanism pivots each tusk relative to its main carriage member between open and closed positions. Each tusk is operable independently of the other.

18 Claims, 8 Drawing Figures

LOAD HANDLING VEHICLE

BACKGROUND OF THE INVENTION

1. Field of the Invention

The present invention relates to lift trucks, and more particularly to lift trucks having boom-or-mast-supported claw-type handling elements with forks for handling elongate loads such as logs.

2. Description of the Prior Art

Existing load handling vehicles, such as the one shown in U.S. Pat. No. 3,669,293, typically have a pair of vertically disposed, laterally spaced apart, articulated claws pivoted to a boom.

However, the claws of known prior art load handling vehicles are interconnected and driven so that they operate only synchronously, not independently. Therefore, the claws of such vehicles cannot be manipulated independently of one another and the load handling capability of such vehicles is thereby limited.

Furthermore, the forks of both claws of such prior vehicles always remain parallel to each other. This makes it difficult to insert these forks under a load unless the load happens to be parallel to the plane of the forks. Consequently, it is hard to insert the forks under and pick up skewed or otherwise uneven loads such as logs in a haphazard pile. In addition, with such vehicles, it is difficult to unload logs onto a surface which is not parallel to the forks, such as the sloping bunks of a log truck parked on a hill. This occurs because each of the claws cannot be independently pivoted to adjust the attitude of each fork so that the load is approximately parallel to the support surfaces onto which it is to be loaded.

The claws of some prior load handling vehicles include a pivoted upstanding main carriage member, a lower forwardly extending fork member for supporting a load and an upper forwardly extending tusk which can be pivoted to grasp a load. However, limitations in the connection between the fork and main carriage member require that such members always maintain a constant angular relationship and prevent manipulation of the main carriage member while its fork remains stationary and supported from below. Therefore, the main carriage members and tusks cannot be used to reach forwardly and pull a load onto the forks while the forks remain supported in stationary positions to receive the load.

Moreover, although the tusks of some prior load handling claws are known to be pivoted independently of one another, the arcs through which such tusks can be pivoted are typically limited because of limitations of the tusk pivoting mechanism. For this reason, the tusks of such vehicles cannot be pivoted to grasp both very small and very large loads.

Furthermore, the boom or mast structure, the carriage heads, and hydraulic mechanisms of existing load handling vehicles commonly obstruct the line of sight from the operator to the load.

Load handling vehicles and carriage heads illustrative of the known prior art and of the foregoing problems are disclosed in U.S. Pat. Nos. 3,669,392; 2,997,193; 3,275,173; 3,125,234; 3,182,833; 2,958,434; 3,352,442; 3,034,821 and 3,817,567.

SUMMARY OF THE INVENTION

In accordance with the present invention, a self-propelled load handling vehicle is provided with a boom or mastmounted carriage head. The carriage head comprises a pair of generally vertically disposed laterally spaced apart, articulated claws. These claws can be manipulated either independently of one another for optimum versatility in handling uneven or skewed load objects, or together for optimum handling speed.

A more specific feature is a main carriage member for each claw which is pivoted to its boom or mast support independently of the main carriage member of the other claw to enable independence of movement of the two claws.

Another feature is a fork member of each claw having a pivotal connection to the boom or mast and a floating type coupling to its associated main carriage member. This feature enables the vertical angle of the fork to be adjusted by pivoting its associated main carriage member and enables forward pivoting movement of the main carriage member without moving the fork when the fork is supported from below.

Still another feature is slotted forks which guide the movement of the tusks in their various closed positions to provide the tusks with lateral stability under load.

An additional feature is a tusk member of each claw which can be pivoted through an exceptionally large arc so that the claw is able to handle efficiently both very large and very small loads.

Another feature is the arrangement of operator station, boom and claws to provide the operator with improved visibility of the surrounding area and of the load being handled.

Primary objects of the invention are:

(a) To provide a load handling vehicle with independently operable load handling claws for maximum versatility in handling loads;

(b) To provide a load handling vehicle having an improved ability to pick up and handle loads, especially those which are uneven or skewed with respect to the vehicle;

(c) To provide a load handling vehicle having an improved ability to unload a load onto a surface which lies in a different plane than that of the vehicle;

(d) To provide a load handling vehicle having an improved ability to handle loads of widely varying sizes; and (e) To provide a load handling vehicle affording maximum visibility of the load and the surrounding area to the operator to improve the safety and efficiency of handling loads.

DETAILED DESCRIPTION OF A PREFERRED EMBODIMENT

Figure 1:
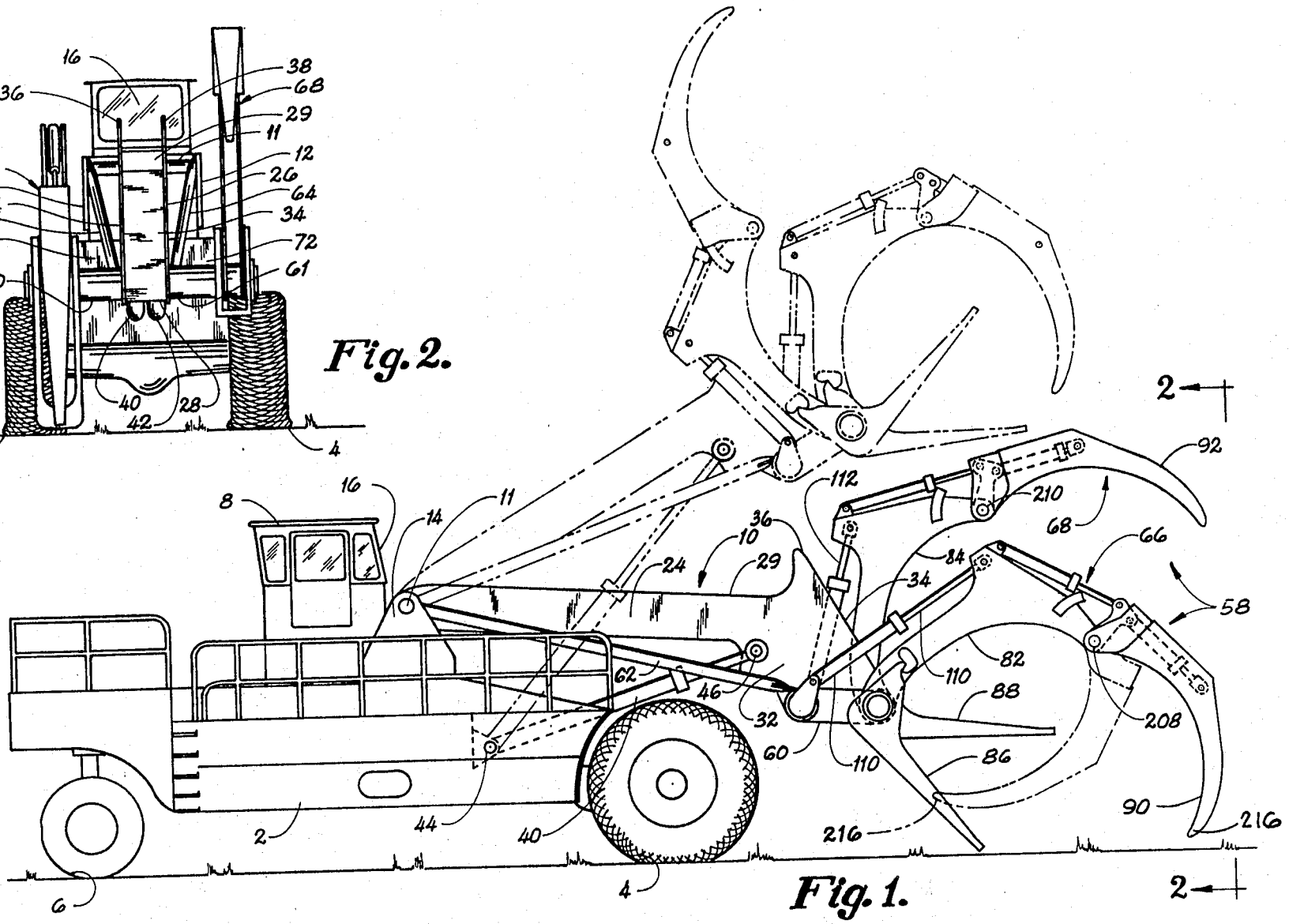
FIG. 1 is a side elevational view of a preferred embodiment of a load handling vehicle in accordance with the invention.
Figure 2:
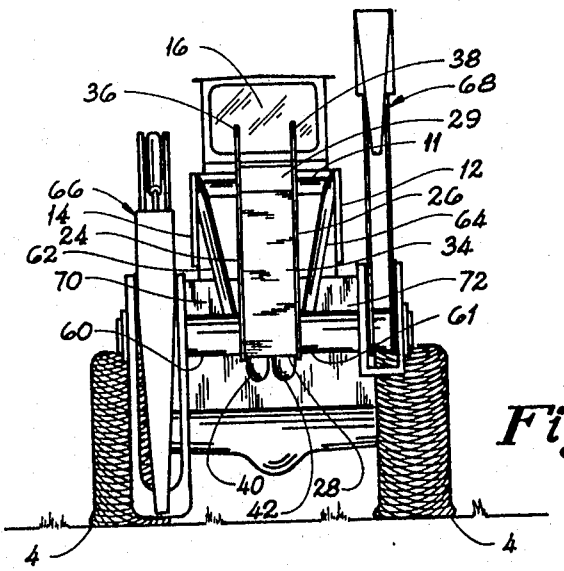
FIG. 2 is a front elevational view of the load handling vehicle of FIG. 1 as viewed from line 2—2 of FIG. 1.

Referring to FIGS. 1 and 2, the load handling vehicle of the invention includes a self-propelled main frame 2 supported on a pair of driven front wheels 4 and a pair of side by side steerable rear wheels 6, only one being shown. An operator's station such as cab 8 is approximately centered between the opposite ends and sides of frame 2.

A boom means 10 extends forwardly from frame 2 and is pivoted to the frame just in front of cab 8 for vertical movement about a boom pivot shaft 11. Pivot shaft 11 extends between a pair of laterally spaced, upright boom support trunnions 12, 14. Boom 10 is connected to the frame below cab window 16 and therefore below the level of the operator in the operator's station. When connected in this manner the operator always has a line of sight along the top of the boom to the load being handled when the boom is raised and lowered. Frame 2 is sloped downwardly toward the front of the vehicle from trunnions 12, 14 to provide clearance for vertical movement of the boom.

Boom 10 comprises a straight, single-section boom of rigid, hollow, box-like structure formed by a pair of vertical side walls 24, 26, a bottom wall 28, and a top wall 29. At the outer or free end of the boom, side walls 24, 26 are enlarged and extend downwardly to form a generally wedge-shaped enlarged end portion 32. An end plate 34, best seen in FIG. 2, closes the outer end of the boom.

Boom side walls 24, 26 also project upwardly at the outer end of the boom beyond top wall 29 to form laterally spaced guard plates 36, 38. These guard plates prevent material from sliding down the boom toward the cab when the boom is in a raised position. The guard plates are offset laterally from the center line of the boom (FIG. 2) so as to not obstruct the line of sight along the top of the boom.

A boom operating means is provided for pivoting the boom about shaft 11. Such means comprises a pair of side by side hydraulic cylinders 40, 42. Each cylinder is pivoted at one end to frame 2 at 44, below boom pivot shaft 11, and at the opposite end to an outer portion of the boom at 46.

A carriage head indicated generally at 58 is supported by a carriage head support means comprising boom side extensions 60, 61 projecting laterally from the bottom of enlarged boom end portion 32. A pair of boom stabilizer tubes 62, 64 on opposite sides of the boom extend from boom pivot shaft 11 to boom side extensions 60, 61 respectively. These boom stabilizer tubes rigidify boom 10, particularly against lateral deflection and twisting under load.

As shown in FIGS. 1 and 2, carriage head 58 includes a pair of articulated claw means 66, 68, one pivotally carried by each of the opposite boom side extensions 60, 61. The claws are generally vertically disposed, laterally spaced apart and symmetrical about the center line of boom 10.

A view space 70 (FIG. 2) is formed between claw 66 and side wall 24 of the boom and is bounded on the bottom by an upper surface of boom side extension 60. A view space 72 is similarly defined on the opposite side of the boom by side wall 26, claw 68 and the upper surface of side extension 61. The width of view spaces 70, 72 is substantial and is approximately equal to the width of the boom. The operator of the vehicle has a clear line of vision through each of these view spaces along the side walls 24, 26 of the main boom to the load being handled.

With reference to FIG. 1, claw 66 defines a load receiving opening and is composed of a main carriage means or member 82, a fork means or member 86, and a tusk means or member 90. Main carriage member 82 is pivotally carried by boom side extension 60 for movement in a generally vertical plane to pivot the claw. Fork member 88 is also pivotally carried by boom side extension 60 and extends forwardly of a lower portion of main carriage member 82 for supporting a load within the load receiving opening. Tusk member 90 is pivotally connected to an upper portion of the main carriage member for movement in a generally vertical plane between an open position to admit a load within the opening and a closed position to grasp a load on the fork member within the opening. Claw 68 defines a separate load receiving opening and is identical to claw 66, having a corresponding main carriage member 84, fork member 88 and tusk member 92.

Figure 5:
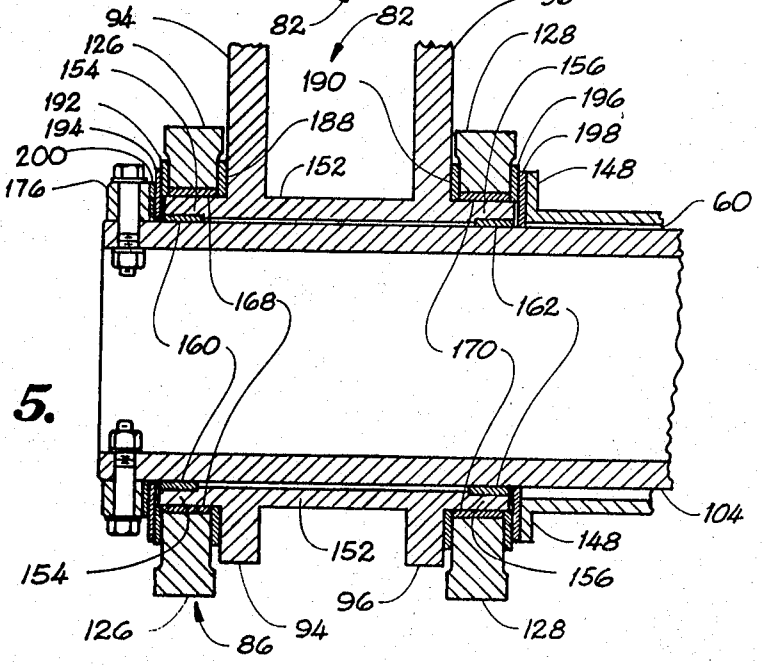
FIG. 5 is a partial sectional view taken along line 5—5 of FIG. 3.
Figure 7:
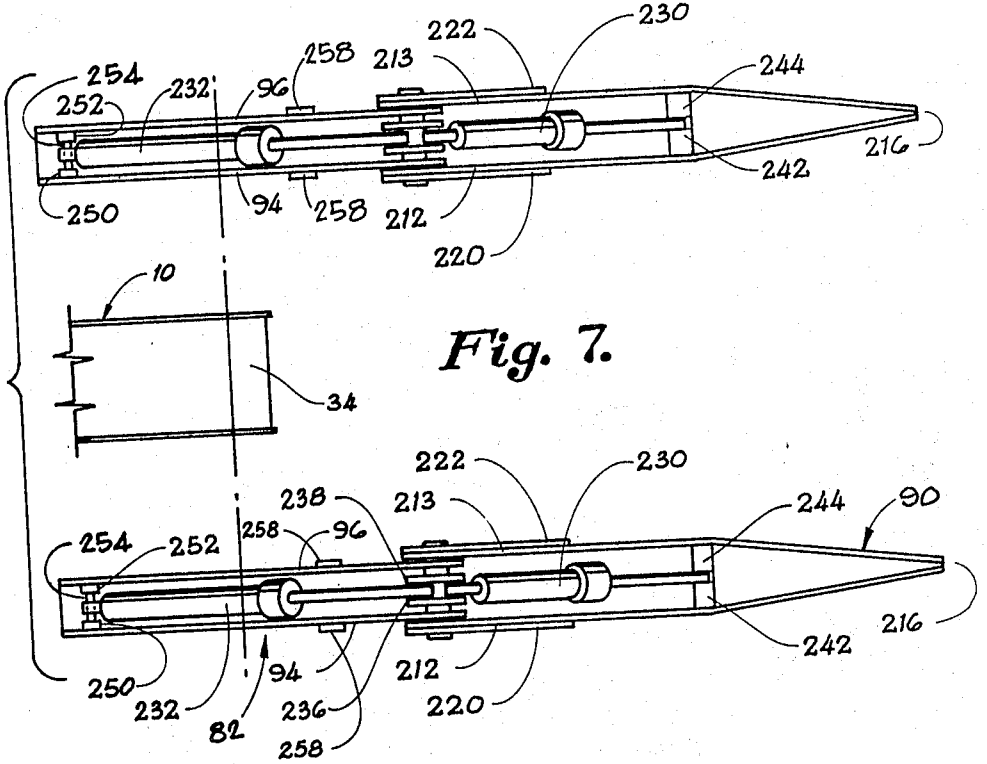
FIG. 7 is a top plan view of the carriage head as viewed from line 7—7 of FIG. 3 with a lower portion of the head deleted for clarity.

As best seen in FIG. 7, the main carriage members are each formed by a pair of generally upstanding, parallel laterally spaced main carriage side plates 94, 96 interconnected by crossmembers (not shown). The side plates are curved forwardly at their upper portions and are joined together at their lower ends by a cylindrical sleeve portion 152 (FIG. 5).

Figure 3:
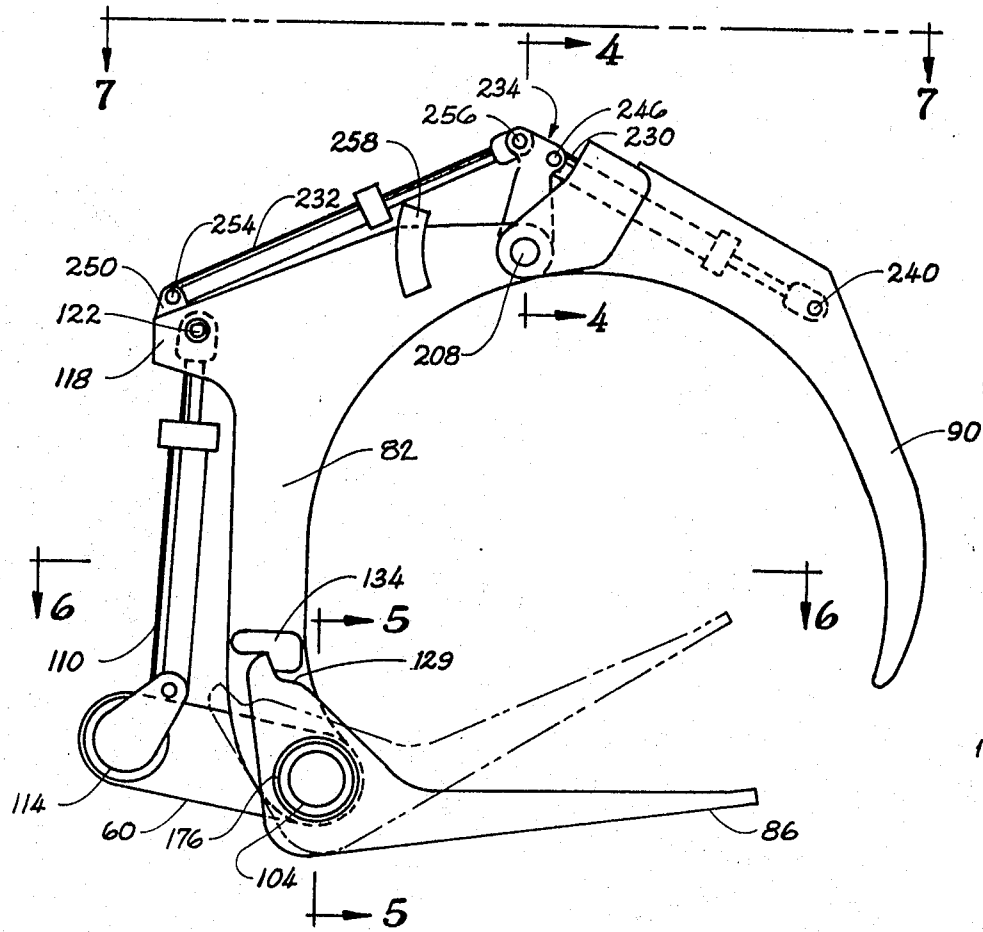
FIG. 3 is a side elevational view of the carriage head portion of the vehicle of FIG. 1 on an enlarged scale.

Each fork includes a pair of parallel laterally spaced apart fork arms 126, 128 (FIG. 6) forming a slot 132 between them. The arms of each fork are joined together at an outer end by a plate 130. As shown in FIG. 3, each fork arm is generally straight from its outer end throughout the major portion of its length but has an upwardly extending portion 129 at its inner end with a large hole therethrough for mounting purposes.

Each tusk 90, 92 includes a pair of rigid laterally spaced apart side plates 212, 213 (FIG. 7) joined together at their outer ends at 216. Reinforcing plates 220, 222 are welded to the inner end portions of side plates 212, 213 to strengthen the tusks at their connections to the main carriage members. Cross members (not shown) interconnect side plates 212, 213 to rigidify the tusk.

Each tusk is symmetrical about a vertical median plane bisecting the associated main carriage member and fork. Therefore, as shown in phantom in FIG. 1, when the tusks are pivoted clockwise to close the load receiving opening the outer end 216 of each tusk enters slot 132 of its associated fork. During further clockwise pivoting, the tusk is guided in the slot and braced by the fork arms against any load-imposed lateral deflection or twisting out of its plane of motion.

Figure 6:
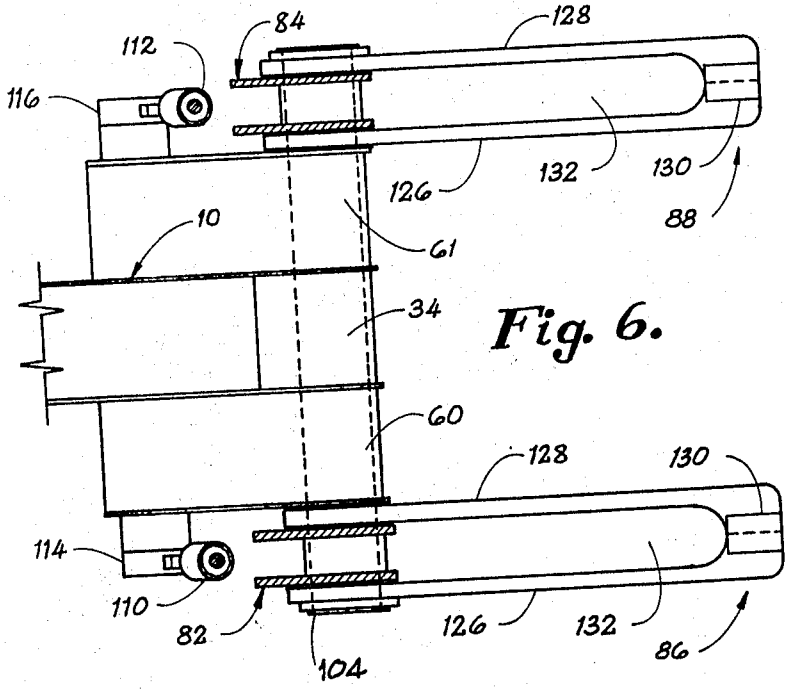
FIG. 6 is a sectional view taken along line 6—6 of FIG. 3.

As shown in FIG. 6, the claws are pivoted to the opposite ends of a pivot tube 104 which extends perpendicularly to boom 10 through boom side extensions 60, 61 and projects beyond the outer ends of these side extensions. Pivot tube 104 thereby provides a common transverse generally horizontal axis about which the claws are free to pivot independently of one another.

The details of the connection of the main carriage and fork components of claw 66 to pivot tube 104 are shown in FIG. 5. Since the connection of claw 68 to such tube is identical, it will not be described in detail. A flanged sleeve 148 is formed at the outer end of boom side extension 60 to limit inward movement of claw 66 along the pivot tube. As previously mentioned, cylindrical sleeve 152 forms the lower end of main carriage member 82. Sleeve 152 is mounted for rotation on pivot tube 104 and carries annular internal bearings 160, 162 on its flange extensions 154, 156 for this purpose. Fork arms 126, 128 are mounted for rotation on the outside of flange extensions 154, 156 respectively, and carry annular flange bearings 168, 170. A collar 176 bolted to pivot tube 104 retains the fork and main carriage assembly on the pivot tube. Annular thrust bearings 188, 190 on the fork arms separate the fork arms from the main carriage side plates and facilitate relative rotation therebetween. Additional thrust bearings 192, 196 on the fork arms, a collar bearing 200 and a bearing 198 on flanged sleeve 148 facilitate rotation of the fork and main carriage member on the pivot tube. Annular shim 194 reduces the lateral play of the fork and main carriage member along the pivot tube and determines their exact position on the tube.

A fork restraining means, such as the fork stops 134 of FIG. 3 are mounted to the outer surfaces of the main carriage side plates. Such stops are positioned to engage the upwardly extending inner end portions 129 of the fork arms to limit the free-floating pivoting movement of the forks. The center of gravity of each of the forks is forward of pivot tube 104 so that whenever the forks are unsupported from below, they pivot clockwise to engage the fork stops. When in unsupported engagement with the fork stops, the forks ivot with their main carriage members. However, as shown in FG. 8 and in phantom in FIG. 3, the forks are free to pvot counterclockwise away from their stops. This enables pivotng movement of the main carriage members independently of their orks within limits when the forks are supported from below.

When connected as described, fork 86 and main carriage member 82 pivot about claw pivot tube 104 in a common generally vertical plane. Similarly, fork 88 and its main carriage member 84 pivot about the pivot tube in another common generally vertical plane.

Figure 4:
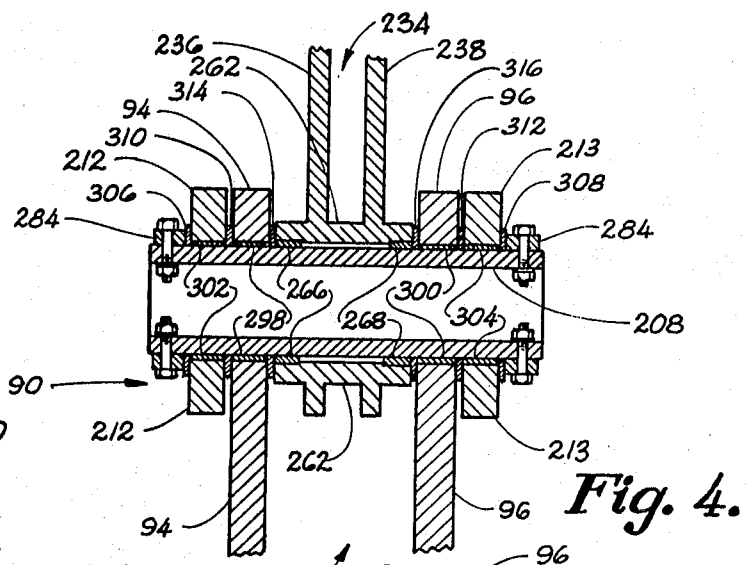
FIG. 4 is a sectional view taken along line 4—4 of FIG. 3.

Tusk 90 and main carriage member 82 are pivotally interconnected by a tusk pivot tube 208. The details of this interconnection are shown in FIG. 4 and described below. Tusk 92 and main carriage member 84 are identically connected together by a tusk pivot tube 210 (FIG. 1) and will not be described in detail. Tusk pivot tube 208 is pivotally carried by the upper end of main carriage side plates 94, 96 in annular bearings 298, 300.

A crank means 234 is mounted on pivot tube 208 between carriage side plates 94, 96. Such crank includes a pair of laterally spaced crank arms 236, 238 joined at their lower ends by a cylindrical sleeve portion 262 rotatably mounted on the pivot tube in bearings 266, 268. The inner end portions of tusk side plates 212, 213 are rotatably mounted on pivot tube 208 in bearings 302, 304 outwardly of the main carriage side plates. End collars 284 bolted to the opposite ends of the pivot tube retain the tusk, main carriage and crank assembly centered on such tube so that such assembly is symmetrical about a vertical median plane bisecting the tusk and main carriage member 82. Thrust bearings 306, 308 separate the collars from the tusk side plates. Similar thrust bearings 310, 312 and 314, 316 separate the tusk side plates from the main carriage side plates, and the main carriage side plates from the crank arms 236, 238.

Tusk restraining means in the form of tusk stops 258 of FIG. 3 mounted to the outer surfaces of the main carriage side plates are engageable with the inner ends of the tusk side plates to limit pivoting movement of the tusks in an opening direction. Clearance is provided between the crank and tusk side plates to prevent the crank from interfering with the pivoting movement of the tusk.

Means are provided for pivoting each of the main carriage members independently of one another. Such means comprise a pair of hydraulic carriage cylinders 110, 112 (FIG. 1) one for each main carriage member. Cylinder 110 is pivotally connected at one end to a cylinder support arm 114 (FIG. 3) which in turn is rigidly connected to boom side extension 60 and projects upwardly therefrom. The opposite, or rod, end of cylinder 110 extends between rear flange extensions 118 of side plates 94, 96 and is pivoted to a pin 122 extending between such flanges. Cylinder 112 is similarly connected at one end to a cylinder support arm 116 (FIG. 6) on side extension 61 and at its opposite end to its main carriage member 84. Cylinders 110, 112 cause their associated main carriage members to pivot forwardly when each cylinder is extended. When connected in this manner, cylinders 110, 112 are operable to pivot their main carriage members and connected claw members through an arc of approximately 65°.

Tusk operating means, comprising a pair of identical tandem cylinder tusk operating mechanisms, one for each tusk, are shown best in FIGS. 3 and 7. Each tusk operating mechanism includes a first hydraulic cylinder 230, second hydraulic cylinder 232, and crank 234. The rod end of cylinder 230 is pivoted to tusk 90 by a pin 240 extending between tusk side plates 212, 213. Spacers 242, 244 on pin 240 center the rod between the side plates. The opposite end of cylinder 230 is pivoted to crank 234 by a pin 246 extending between crank arms 236, 238. One end of second cylinder 232 is pivoted to main carriage member 82 by a pin 254 which extends between ears 250, 252 on the main carriage side plates. The rod end of cylinder 232 is pivoted to crank 234 by a pin 256 extending between the crank arms.

When cylinder 230 extends as viewed in FIG. 3. tusk 90 pivots clockwise on tusk pivot tube 208 toward its fork 86 and a closed position because cylinder 232 holds crank 234 in a fixed position. When cylinder 232 extends, tusk 90 pivots further in a clockwise direction toward another closed position to make the load receiving opening within the claw even smaller than before. This happens because cylinder 230 now holds crank 234 in a fixed position. When connected in this manner, cylinders 230 and 232 can pivot tusk 90 through a total arc of approximately 180°, each cylinder contributing about 90° to the total arc of movement.

Figure 8:
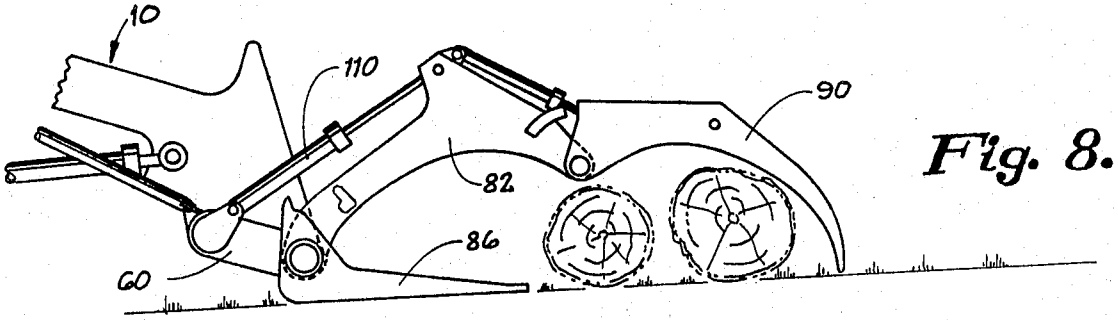
FIG. 8 is a side elevational view of the carriage head portion of the load handling vehicle of FIG. 1, but in a different position of adjustment than that shown in FIG. 3.

The large arc through which the tusks can pivot increases the capability of the vehicle to handle loads of widely varying size. Thus, when the tusk is pivoted to its maximum closed position (see FIG. 1), the tusk can grasp a load having a small diameter, such as a single log, and hold it against the main carriage member and fork. Conversely, when opened fully, the tusk provides a maximum opening for receiving large diameter loads such as a truckload of logs. This wide open position of the tusks is also useful when, as shown in FIG. 8, the fork is supported from below and the main carriage member is pivoted forwardly to extend the tusks beyond a load. The tusks and carriage members can then be worked to pull the load onto the forks.

The cylinders connected to each claw are positioned generally in the vertical plane containing the connected claw so that they do not obstruct view spaces 70, 72. Therefore, the arrangement of the claws and cylinders of the invention increases the visibility of the work area surrounding the vehicle so that the vehicle is safer to operate. In addition, the visibility of the load to the operator is enhanced.

All of the hydraulic cylinders of the load handling vehicle are supplied with pressure fluid from a source on frame 2 through conventional hydraulic circuitry.

The controls (not shown) for the hydraulic circuitry are located in cab 8. The controls include a control mechanism for controlling the operation of each cylinder of each claw independently of one another and independently of the cylinders of the other claw. In addition, to optimize load handling speed when independent manipulation of the claws is not necessary, the controls may include a single wobble stick for simultaneous operation of both claws and the boom. In one version, when the wobble stick is pushed forwardly, the boom descends and when pulled back the boom ascends. Pushing the wobble stick laterally to the left pivots both main carriage members forwardly about their pivots simultaneously. Pushing the wobble stick laterally to the right pivots both main carriage members rearwardly about their pivots simultaneously. When a button on top of the wobble stick is pushed, both tusks close fully on the load as far as possible to grip the load securely. By moving the stick in the four diagonal directions, raising and lowering of the boom occurs simultaneously with the pivoting of both main carriage members. For example, pushing the wobble stick in the diagonal direction between the forward and left positions simultaneously raises the boom and pivots both main carriage members forwardly. Therefore, for many operations, the operator can control movement of the boom and claws with one hand, while the other hand is free to steer the vehicle.

Operation

FIG. 1 shows the load handling vehicle of the present invention with the claws disposed in different positions of adjustment. Further positions of the claws are shown in phantom to demonstrate the independence of manipulation of each claw.

In handling a load, such as in loading a log truck, the boom is raised so that the forks are off the ground and the lift truck approaches the logs to be loaded with its tusks open. The main carriage members are pivoted to adjust the attitude of the forks with respect to that of the logs so that the forks can be inserted under the logs. With the forks beneath the logs, the tusks are pivoted to a closed position, dragging logs into the claw opening and finally holding the captured truck load of logs firmly on the forks and against the main carriage members. With the claws remaining closed, the boom is raised. At the same time the claws may be pivoted upwardly to bring the center of gravity of the load closer to the boom. The lift truck with its truck load of logs approaches the log truck, which may be parked on an incline so that its bunks are not parallel to the load of logs. Consequently, the claws are independently pivoted until the attitude of the forks, and hence the load of logs, is approximately parallel to the bunks. The boom is then lowered and at the same time the claws are pivoted downwardly. The tusks are opened to release the logs onto the truck. The lift truck then approaches additional logs for loading.

With reference to FIG. 8, after approaching the logs with the tusks open, the boom may be lowered until the forks are supported from below by the ground or other logs. The main carriage members are then pivoted forwardly to move the tusks to a position forwardly beyond the logs. The tusks are then pivoted toward a closed position and at the same time the main carriage members are pivoted rearwardly so that the logs are pulled or dragged onto the forks. When supported from below, the forks will tend to remain stationary when the main carriage members and tusks are manipulated to drag the logs onto the forks. For this reason, a log which has been dragged onto the forks will tend to remain in an undisturbed position on the forks even though the main carriage members and tusks are then operated to pull additional logs onto the forks.

While this invention has been described in an embodiment wherein a carriage head is mounted to a boom, the invention may also take forms wherein the carriage head is mounted on other types of load lifting members. For example, the carriage head could be carried by the vertically movable element of a conventional lift truck mast.

Having illustrated and described the principles of my invention with reference to one preferred embodiment, it should be apparent to those persons skilled in the art that such invention may be modified in arrangement and detail without departing from such principles. I claim as my invention all such modifications as come within the true spirit and scope of the following claims.

I claim:

1. A load handling vehicle comprising:

a main frame;

boom means pivotally mounted at one end to the frame for movement about a pivot axis in a generally vertical plane;

boom operating means for raising and lowering said boom means about said pivot axis;

a pair of generally vertically disposed, laterally spaced apart, articulated claw means each defining a load receiving opening and being operable to open to admit a load within said opening and close to grasp a load within said opening, wherein each said claw means includes a main carriage means pivotally connected to a free end portion of said boom means for movement relative to said boom means and relative to the main carriage means of the other claw means in a generally vertical plane, fork means extending forwardly of a lower portion of said main carriage means for supporting a load within said opening, and tusk means pivotally connected to an upper portion of said main carriage means for movement between an open position to admit a load within said opening and a closed position to grasp a load within said opening; means for pivoting each of said main carriage means independently of the other; and tusk operating means for pivoting each of said tusk means in a generally vertical plane between said open and closed positions.

2. The vehicle of claim 1 wherein the main carriage means of both claw means pivot about a common transverse generally horizontal axis and wherein the fork means of both claw means are pivotally connected to said boom means for pivoting about said common transverse axis.

fluid pressure which is generated by the fluid pressure supply device I.

The detector 51 comprises a diaphragm type actuator 53, a switch element 54, and a DC power source B in the form of a battery, such as the engine battery. The diaphragm type actuator 53 is divided into two chambers on opposite sides of the diaphragm, one being connected to the intake manifold of the engine by means of a rubber pipe and having a spring of a predetermined spring constant interposed therein, while the other is open to the atmosphere. Further, the diaphragm has secured thereto a rod member which extends from the other of the chambers and at its opposite end has a movable contact 54*a*. In this instance, the spring constant of the spring member is determined such that, under the normal operating conditions, except when the engine is in a braking condition, the combined force of the vacuum pressure from the intake manifold of the engine and the spring force of the spring member overcomes the atmospheric pressure introduced in the other chamber, and such that on the contrary, under engine braking conditions, the atmospheric pressure in the other chamber overcomes the above combined force to compressively deform the diaphragm upwardly. A contact 54*b* is connected to a positive terminal of the DC power source B, through a solenoid coil of an electromagnetic on-off valve 55, which will be described later, while another contact 54*c* is connected to the negative terminal of the DC power source B. Therefore, under engine braking conditions, the diaphragm is deformed upwardly, as seen in FIG. 6, holding the movable contact 54*a* of the switch element 54 in contacting engagement with the stationary contacts 54*b* and 54*c* to energize the solenoid of the electromagnetic valve 55.

The cut-off valve 52 includes the electromagnetic valve 55 which has one port, communicated with a passage 88 between the pressure regulator valve 8 of the pressure supply device I, connected to fluid pressure supply passage through a check valve 85, and the oil reservoir 6' through a passage 56, while the other port of the electromagnetic on-off valve 55 is communicated with a vent pressure induction passage 81 of the pressure regulator valve 8 through a passage 57. Therefore, when the electromagnetic on-off valve 55 is in the position shown in FIG. 6, that is, under normal vehicle driving conditions, the vent pressure is supplied to the passage 57, but not to the other passage 56, since the passage 57 is cut off from the passage 56 by the on-off valve 55.

The other passage 82 of the pressure regulator valve 8 is discharged into two branch passages 83 and 84, which are provided with check valves 85 and 86, respectively, the branch passages 83 and 84 being fluidly communicated with the respective fluid pressure supply passages II.

Thus, when the fluid pressure in one of the fluid pressure supply devices I rises for some reason extraordinarily or beyond a predetermined pressure level of the pressure regulator valve 8, the abnormal pressure is allowed to escape to the oil reservoir 6' through the passage 82, pressure regulator valve 8, and passage 88, without imposing adverse effects on the other one of the fluid pressure supply devices I.

The internal combustion engine of this third embodiment of the invention operates in a manner similar to the engine of the first embodiment. Under normal running conditions of the vehicle, the pressure supplied from the intake manifold is relatively close to the atmospheric pressure level, so that the diaphragm member of the diaphragm actuator 53 is deformed downwardly by the combined action of the supplied pressure and the spring force, as shown in FIG. 6, to disengage the movable contact 54*a* of the switch element 54 from the stationary contacts 54*b* and 54*c*. In this instance, as the electromagnetic on-off valve 55 is still in the cut-off position, the fluid pressure, which is supplied by the fluid pressure supply device I, is applied without being allowed to escape, to effect correct control of the opening and closing operation of the intake valve of the auxiliary combustion chamber.

On the other hand, under engine braking conditions, the pressure of the intake manifold is developed to a high level so that the diaphragm member of the actuator 53 is deformed upwardly, as seen in FIG. 6, by the atmospheric pressure against the action of the spring force, bringing the movable contact 54*a* of the switch element 54 into contacting engagement with the stationary contacts 54*b* and 54*c*, whereupon the solenoid coil of the electromagnetic on-off valve 55 is energized by the voltage from the DC source B through the switch element 54 to push the on-off valve upwardly, as seen in the drawing, from the cut-off position to the conductive position, against the action of the spring. Thus, the fluid pressure which is generated by the reciprocating action of piston member 2 of the fluid pressure supply device I in synchronism with the engine rotation is allowed to escape to the oil reservoir 6' through the passage 83 and check valve 85, or through the passage 84 and check valve 86, and then through the passage 82, vent pressure induction passage 81, passage 57, electromagnetic on-off valve 55, and passages 56 and 88. Therefore, a fluid pressure for driving the intake valve of the auxiliary combustion chamber is not generated. The intake valve of the auxiliary combustion engine can thus be maintained in the closed state during the engine braking conditions, such that the fuel does not flow into the auxiliary combustion chamber, and the amount of unburned components of the engine exhaust gas during such engine braking conditions can thus be reduced by a considerable degree, as can be the fuel costs.

The foregoing description refers to the engine braking conditions as an example of the particular operating condition of the engine. However, the third embodiment of the invention is not limited thereto, but presumably may be applied to other operating conditions, such as, for example, sudden acceleration and sudden deceleration conditions.

An important feature of the present invention resides in the fact that it is extremely easy to stop the drive of the intake valve of the auxiliary combustion chamber under engine braking conditions, since the intake valve of the auxiliary combustion chamber is driven hydraulically and independently of the mechanical valve operating mechanism which drives the intake and exhaust valves of the main combustion chamber.

A fourth embodiment of an internal combustion engine formed in accordance with this invention is hereafter explained with reference being made to FIG. 7, and particularly emphasizing the differences relative to the internal combustion engine of the third embodiment, already described.

The internal combustion engine of this fourth embodiment is different from the others in that the invention is applied to a four-cylinder, in-line type internal combustion engine. In order to control the opening and tusk operating means for pivoting each of said tusk means in a generally vertical plane between said open and closed positions.

14. The load carriage apparatus of claim 13 wherein the main carriage means of both claw means pivot about a common transverse generally horizontal axis and wherein the fork means of both claw means are pivotally connected to the load lifting member for pivoting about said common transverse axis.

15. The load carriage apparatus of claim 14 wherein said tusk operating means is operable to pivot the tusk means of each claw means independently of the tusk means of the other claw means and independently of their associated said main carriage means.

16. The load carriage apparatus of claim 13 wherein each of said fork means comprises a pair of laterally spaced apart fork arms, the fork arms of each fork means being pivotally connected at one end to the load lifting member and connected together at the other end to form a slot therebetween, each fork means being mounted for pivotal movement relative to its associated said main carriage means, and wherein each of said tusk means pivots in a generally vertical plane passing through the slot so that the end portion of each said tusk means is disposed within the slot when each said tusk means is pivoted to a position closing the load receiving opening.

17. The load carriage apparatus of claim 13 wherein the means for pivoting each main carriage means comprises a pair of hydraulic cylinders, one for each main carriage means, each of said cylinders being connected to said associated main carriage means and to the carriage support member.

18. The load carriage apparatus of claim 13 wherein said tusk operating means comprises a separate means for pivoting each one of the pair of tusk means, each of these latter means comprises a crank means connected pivotally to an upper portion of the associated said main carriage means for movement about a crank axis normal to the plane of movement of the associated said tusk means, a first hydraulic cylinder pivotally connected at one end to said crank means at a position spaced from said crank axis and pivotally connected at the opposite end to the associated said tusk means at a position spaced from the axis about which said tusk means is pivoted, and a second hydraulic cylinder pivotally connected at one end to said crank means at a position spaced from said crank axis and pivotally connected at the opposite end to the associated said main carriage means at a position spaced from the axis about which said tusk means pivots, such that extension of said first cylinder pivots said tusk means through a first predetermined arc about said tusk pivot axis toward a closed position and extension of said second cylinder pivots said tusk means through an additional predetermined arc toward said closed position.

* * * * *

UNITED STATES PATENT OFFICE

CERTIFICATE OF CORRECTION

Patent No. 4,106,646 Dated August 15, 1978

Inventor(s) Charles E. Weisgerber

It is certified that error appears in the above-identified patent and that said Letters Patent are hereby corrected as shown below:

Columns 9 and 10 should be deleted and substituted with the attached Columns 9 and 10, respectively.

Column 5, line 30, "ivot" should be --pivot--.
line 32, "pvot" should be --pivot--.
line 35, "orks" should be --forks--.

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*

3. The vehicle of claim 1 wherein the fork means of each claw means is pivotally connected to said boom means for movement in a generally vertical plane.

4. The vehicle of claim 1 wherein said tusk operating means is operable to pivot the tusk means of each claw means independently of the tusk means of the other claw means and independently of their associated said main carriage means.

5. The vehicle of claim 1 including an operator's station on said frame and wherein said boom means comprises a rigid one-piece boom including a longitudinally straight boom top surface extending unobstructed from the pivotally connected end of said boom to a downturned free end portion thereof, said boom being connected to the frame at a position such that an operator in said station has a clear line of sight to said claw means along the top of said boom in all operating positions of said boom.

6. The vehicle of claim 5 wherein said boom includes a pair of boom side extensions extending laterally from opposite sides of a lower portion of a free end of said boom, said claw means being pivoted to said boom side extensions at positions spaced equidistant from opposite sides of said boom to define a view space between each said claw means and said boom such that an operator in said station has a clear line of sight through the view spaces to the load being handled.

7. The vehicle of claim 6 wherein said claw pivoting means comprises a separate hydraulic cylinder connected to each claw means and carried by the associated said boom side extension generally in the plane of the connected claw means so as to enable the operator of the load handling vehicle to have a clear line of sight through the view spaces to the load being handled.

8. The vehicle of claim 6 including a pair of boom stabilizer means on opposite sides of said boom and pivotally connected at one set of ends to said frame for pivoting about said boom pivot axis and connected at an opposite set of ends to respective boom side extensions in positions so as to not obstruct said view spaces.

9. The vehicle of claim 6 wherein said boom includes a pair of laterally spaced apart upright guard plate means at the free end portion thereof, said guard plate means projecting upwardly from said boom for deflecting material away from said boom.

10. A load handling vehicle comprising:

a main frame;

an operators station on said frame;

boom means pivotally connected at one end to the frame for movement about a pivot axis in a generally vertical plane;

boom operating means for raising and lowering said boom means about said pivot axis;

said boom means comprising a rigid one-piece boom centered longitudinally between opposite sides of said frame and including a longitudinally straight boom top surface extending unobstructed from the pivotally connected end of said boom to a downturned free end portion thereof, the pivotal connection of said boom to said frame being positioned forwardly of said operators station and at an elevation sufficiently low to provide lines of sight from said station forwardly along and above said boom top surface, said boom including a pair of boom side extensions extending equidistant in opposite directions laterally from opposite sides of said downturned free end portion of said boom;

a pair of generally vertically disposed laterally spaced apart articulated claw means, each claw means defining a load receiving opening and being operable to open to admit a load within said opening and close to grasp a load within said opening, said pair of claw means being pivoted one to the laterally outer end of each said boom side extension for movement of said pair in generally vertical parallel planes which are parallel to and spaced equidistant on opposite sides of the generally vertical plane of movement of said boom;

claw operating means for pivoting and opening and closing said pair of claw means in their respective vertical planes, said claw operating means being positioned generally in the vertical planes of movement of said claw means so as to maintain the space between said pair of claw means free of obstructions;

said pair of claw means being spatially and mechanically separated from each other and connected to said boom only at the level of said boom side extensions such that said boom side extensions, said claw means with their associated said operating means and said boom define the limits of unobstructed view corridors from said operators station to a load supported by and extending between said pair of claw means, a first such corridor extending centrally between the pair of claw means along said boom top surface and second and third such corridors extending along said boom into spaces between the opposite sides of said pair of claw means at said free end portion.

11. The load handling vehicle of claim 10 wherein said boom means comprises a straight rigid boom, said boom being hollow and comprised of a planar top wall, a pair of vertical spaced apart side walls and a bottom wall, said boom being connected to the frame at a position such that an operator in said station has a clear line of sight to said claw means along said top wall in all operating positions of said boom.

12. The vehicle of claim 10 including claw pivoting means for pivoting each of said claw means about its pivotal connection with said associated boom side extension, said claw pivoting means being positioned so that the line of sight through each view space is not obstructed.

13. A load carriage apparatus for connection to a load lifting member of a load handling vehicle comprising:

a pair of generally vertically disposed claw means each adapted to be pivoted independently of the other to the load lifting member at laterally spaced apart positions, each of said claw means defining a load receiving opening and comprising a main carriage means pivotally connected to the load lifting member for movement relative to said load lifting member and relative to the main carriage means of the other claw means in a generally vertical plane, fork means extending forwardly of a lower portion of said main carriage means for supporting the load within said opening, and tusk means pivotally connected to an upper portion of said main carriage means for movement between an open position to admit a load within said opening and a closed position to grasp a load within said opening;

means operable for pivoting each of said main carriage means relative to the other; and